US010369807B2

(12) United States Patent
Wooldridge et al.

(10) Patent No.: US 10,369,807 B2
(45) Date of Patent: Aug. 6, 2019

(54) LABEL MODULE FOR PRINTING CUSTOM CUSTOMER ENGAGEMENT LABELS

(71) Applicant: Entrust Datacard Corporation, Shakopee, MN (US)

(72) Inventors: Cory Wooldridge, Shakopee, MN (US); Kyle Johnson, Shakopee, MN (US); Jon Wawra, Shakopee, MN (US); Tim Flitsch, Shakopee, MN (US); Stu Bodmer, Shakopee, MN (US); Wade Kragtorp, Shakopee, MN (US); Marco Freudenberger, Reinheim (DE); Bob Steinbrueck, Shakopee, MN (US)

(73) Assignee: Entrust Datacard Corporation, Shakopee, MN (US)

( * ) Notice: Subject to any disclaimer, the term of this patent is extended or adjusted under 35 U.S.C. 154(b) by 0 days.

(21) Appl. No.: 15/586,789

(22) Filed: May 4, 2017

(65) Prior Publication Data

US 2017/0320335 A1 Nov. 9, 2017

Related U.S. Application Data

(60) Provisional application No. 62/332,874, filed on May 6, 2016.

(51) Int. Cl.
*B41J 13/12* (2006.01)
*B41J 3/407* (2006.01)

(52) U.S. Cl.
CPC ..... *B41J 3/4075* (2013.01); *B41J 13/12* (2013.01)

(58) Field of Classification Search
CPC ..... B41J 3/4075; B41J 13/12
See application file for complete search history.

(56) References Cited

U.S. PATENT DOCUMENTS

| | | | |
|---|---|---|---|
| 5,266,781 A | 11/1993 | Warwick et al. | |
| 5,451,037 A | 9/1995 | Lundstrom | |
| 5,588,763 A | 12/1996 | Nubson et al. | |
| 6,729,656 B2 | 5/2004 | Kubert et al. | |

(Continued)

FOREIGN PATENT DOCUMENTS

| | | | |
|---|---|---|---|
| EP | 2540519 | 1/2013 | |
| JP | H08 268420 A | 10/1996 | |
| JP | 10-006564 * | 1/1998 | ..... B41J 3/01 |

OTHER PUBLICATIONS

International Search Report and Written Opinion of international application No. PCT/US2017/031003, dated Aug. 11, 2017, 15 pages provided.

(Continued)

*Primary Examiner* — Yaovi M Ameh
(74) *Attorney, Agent, or Firm* — Hamre, Schmann, Mueller & Larson, P.C.

(57) ABSTRACT

A label printer mechanism that is configured to produce and affix custom printed customer engagement labels to personalized plastic cards and other substrates. The custom printed customer engagement labels can be used for a number of purposes including, but not limited to, instructions to the intended recipients of personalized plastic cards for activation of the personalized plastic cards, marketing of products and/or services to the recipients, and combinations of activation and marketing.

5 Claims, 12 Drawing Sheets

(56) References Cited

U.S. PATENT DOCUMENTS

| | | | | |
|---|---|---|---|---|
| 6,896,022 | B2 | 5/2005 | Galles et al. | |
| 6,902,107 | B2 | 6/2005 | Shay et al. | |
| 7,059,532 | B2 | 6/2006 | McCumber | |
| 8,096,719 | B1 * | 1/2012 | Bailey | B41J 3/387 400/621 |
| 9,315,052 | B1 * | 4/2016 | Harashina | B41J 3/4075 |
| 2011/0163158 | A1 | 7/2011 | Brown et al. | |
| 2012/0031545 | A1 * | 2/2012 | Vaccaro | G09F 1/00 156/153 |
| 2015/0085047 | A1 | 3/2015 | Beech et al. | |

OTHER PUBLICATIONS

Extended European Search Report; European Patent Application No. 17793319.9; Apr. 29, 2019 (11 pages).

* cited by examiner

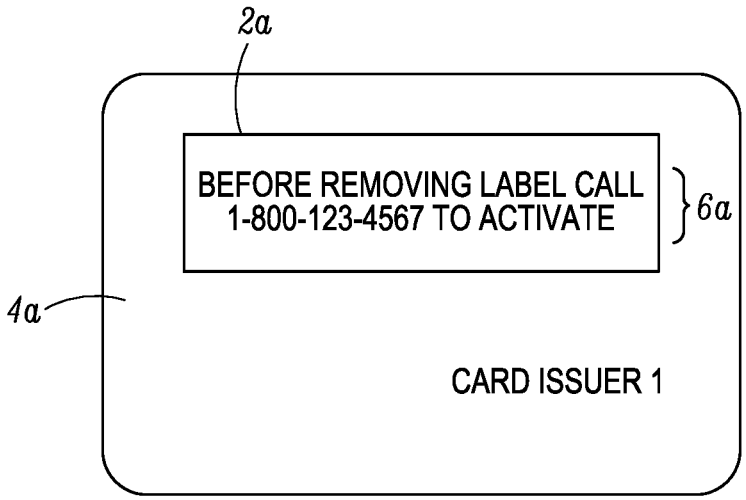
FIG. 1A - Prior Art
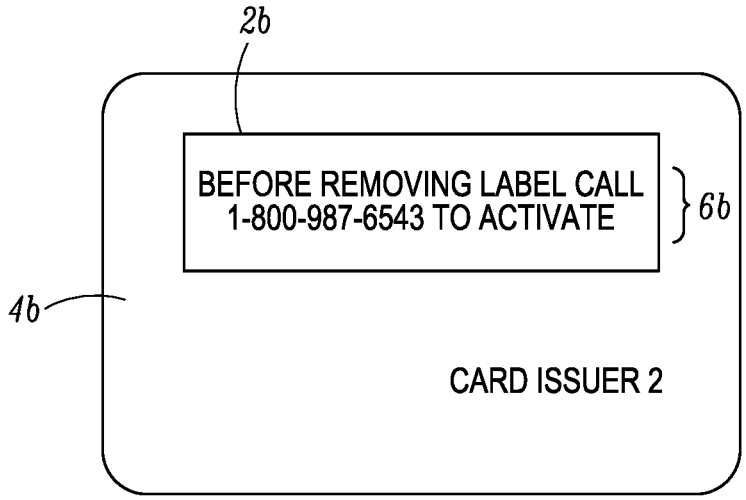
FIG. 1B - Prior Art

LABEL MODULE FOR PRINTING CUSTOM CUSTOMER ENGAGEMENT LABELS

FIELD

The technical disclosure herein relates to the production of customer engagement labels that can accompany personalized plastic cards, such as financial cards including credit and debit cards, identification cards, driver's licenses, and other personalized plastic cards that are distributed to end users. This disclosure also relates to the production of other types of customer engagement labels that accompany other substrates. The customer engagement labels can be used for a number of purposes including, but not limited to, activation of personalized plastic cards by recipients of the cards, marketing of products and/or services to the recipients, and combinations of activation and marketing.

BACKGROUND

When a credit card is mailed to the intended recipient of the credit card, a card activation label is typically applied to the credit card prior to mailing the credit card. The card activation label contains information, such as a telephone number and instructions for activating the credit card. By following the instructions on the card activation label the recipient can activate the credit card. The card activation label is adhered to the credit card with an adhesive that permits removal of the card activation label by the recipient.

Card activation labels are produced in pre-printed batches that are specific to the card issuer of the credit cards to which the card activation labels are to be adhered. For example, with reference to FIG. 1A, for Card Issuer 1, a card activation label 2*a* that is applied to a credit card 4*a* of Card Issuer 1 is printed with activation information 6*a* specific for Card Issuer 1. On the other hand, referring to FIG. 1B, for Card Issuer 2, a card activation label 2*b* that is applied to a credit card 4*b* of Card Issuer 2 is printed with activation information 6*b* specific for Card Issuer 2 which is different than the activation information for Card Issuer 1.

The card activation labels 2*a*, 2*b* are applied to the credit cards 4*a*, 4*b* in a label applicator mechanism. An example of a label applicator mechanism is described in U.S. Pat. No. 6,896,022 the entire contents of which are incorporated herein by reference. In the label applicator mechanism, the pre-printed card activation labels for a specific card issuer, for example, Card Issuer 1, are supplied from a label supply for application to the credit cards issued by Card Issuer 1. However, if cards from a different card issuer, for example Card Issuer 2, are present, the label applicator mechanism needs to be shut down and the label supply replaced with the label supply carrying the pre-printed card activation labels for Card Issuer 2. This need to shut down the mechanism to replace the label supply reduces the card throughput (e.g. the number of cards labeled per hour) of the label applicator mechanism, and if the label applicator mechanism is used in combination with a card personalization system that is supplying the credit cards to the label applicator mechanism, also reduces the card throughput of the card personalization system.

SUMMARY

This description describes the production of custom printed customer engagement labels that can accompany personalized plastic cards, such as financial cards including credit and debit cards, identification cards, driver's licenses, and other personalized plastic cards that are distributed to customers such as in mailed envelopes. The custom printed customer engagement labels described herein can be applied to other substrates, such as envelopes, letters, and other substrates, that are distributed to customers. The custom printed customer engagement labels described herein can be used for a number of purposes including, but not limited to, instructions to the intended recipients of personalized plastic cards for activation of the personalized plastic cards, marketing of products and/or services to the recipients, and combinations of activation and marketing.

The custom printed customer engagement labels can be custom printed within, and applied to the plastic cards in, a label printer mechanism. The label printer mechanism includes a label supply roll containing a plurality of labels carried on a carrier web. A label print engine of the label printer mechanism can custom print each of the labels. After printing, a label transfer station of the label printer mechanism transfers the custom printed labels from the carrier web onto the plastic cards. In some embodiments, the label printer mechanism can be used as a "stand-alone" or an "off-line" mechanism where the label printer mechanism is not used directly in combination with a card personalization system where the personalized plastic cards are first personalized in a separate card personalization system and then separately loaded into an input of the label printer mechanism for processing by the label printer mechanism. In other embodiments, the label printer mechanism can be used as an "in-line" mechanism where the label printer mechanism is used directly in combination with a card personalization system that directly supplies personalized plastic cards to the label printer mechanism.

In one embodiment, the label printer mechanisms and methods described herein can result in a high card throughput (also referred to as a label to card affix rate). For example, in one embodiment, the described label printer mechanisms and methods can print and affix custom printed labels at a rate (i.e. a label to card affix rate) of at least 500 cards per hour or at a rate of at least 1,000 cards per hour. In another embodiment, the described label printer mechanisms and methods can print and affix custom printed labels at a rate of at least 1,500 cards per hour. In still another embodiment, the described label printer mechanisms and methods can print and affix custom printed labels at a rate of at least 2,000 cards per hour. In still another embodiment, the described label printer mechanisms and methods can print and affix custom printed labels at a rate of at least 2,500 cards per hour.

Another unique feature of the described label printer mechanisms and methods is that the labels can be printed when the carrier web that carries the labels is moving in a reverse or second direction opposite to the direction that the web moves during a step of affixing/attaching the labels to the personalized plastic cards. This reverse move printing helps to increase throughput.

Still another unique feature is that the described label printer mechanisms and methods utilize an ink jet print engine that employs ink jet printing. The ink jet print engine can print on the labels in black and white or it can print full color. In one embodiment, a system described herein can include a card personalization mechanism that can personalize plastic cards, and a label printer mechanism located upstream or downstream of the card personalization mechanism. The label printer mechanism can have an ink jet print engine that performs ink jet printing on labels to produce custom printed customer engagement labels, and a label transfer station that transfers the custom printed customer engagement labels onto the plastic cards.

Another unique feature is that the described label printer mechanisms and methods permit the production and affixing of custom full color labels. The use of an ink jet print engine is not required. Any type(s) of print engine(s) that can print full color labels can be used.

Another unique feature is that the described label printer mechanisms and methods allow custom labels to be printed and affixed to the cards without substantially altering the label to card affix rate, i.e. the rate at which labels are printed and affixed to cards, of the label printer mechanisms. One example of a substantial change to the label to card affix rate would be stopping operation of the printer mechanism to change out pre-printed label stock. By not having to stop operation of the printer mechanism to swap out pre-printed label stock, the label to card affix rate can be substantially maintained, and downtime associated with swapping out pre-printed label stock is reduced and/or eliminated.

Another unique feature of the described label printer mechanisms and methods is that each label can be printed with a unique identifier including, but not limited to, a serial number, a two-dimensional bar code, and the like, that can be used to verify that the correct custom printed label has been, or will be, affixed to the intended card or other substrate.

The label printer mechanisms and related methods described herein can also incorporate a unique sliding drawer and moveable ink cartridge housing that allows for easier access to both the label supply roll and to the ink cartridge housing for supply maintenance operations.

In one embodiment described herein, a method includes printing on a first label in a label printer mechanism to produce a first custom printed customer engagement label, the first custom printed customer engagement label being printed with a first set of data. Within the label printer mechanism, the first custom printed customer engagement label is affixed to a surface of a first card. After the first custom printed customer engagement label is produced, printing on a second label in the label printer mechanism to produce a second custom printed customer engagement label, the second custom printed customer engagement label being printed with a second set of data that differs from the first set of data. Within the label printer mechanism, the second custom printed customer engagement label is affixed to a surface of a second card. The first custom printed customer engagement label and the second custom printed customer engagement label are produced in sequence without substantially altering the label to card affix rate of the label printer mechanism. The printed data can include, for example, an activation number, logo, image, advertisement, URL or website address, marketing message or combinations thereof.

In another embodiment described herein, a method includes printing a first custom printed customer engagement label on a carrier web using a print head in the label printer mechanism; after printing the first custom printed customer engagement label, moving the carrier web in a first direction to a label transfer station and transferring the first custom printed customer engagement label to a surface of a plastic card; after transferring the first custom printed customer engagement label, reversing direction of the carrier web so that the carrier web is moved in a second direction opposite the first direction past the print head; and as the carrier web is moving in the second direction, printing on a label carried by the carrier web using the print head to produce a second custom printed customer engagement label.

In another embodiment described herein, a label printer mechanism includes a label supply roll containing a plurality of labels carried on a carrier web, a supply take-up roll connected to the carrier web that takes up the carrier web, a web travel path between the label supply roll and the supply take-up roll, a label print engine disposed along the web travel path that prints on the labels carried on the carrier web, and a label transfer station disposed along the web travel path between the label print engine and the supply take-up roll that transfers printed labels from the carrier web onto plastic cards, wherein the label printer mechanism prints and affixes printed labels to the plastic cards at a rate of at least 500 cards per hour.

In still another embodiment described herein, a card system includes a card personalization mechanism that can personalize plastic cards, and a label printer mechanism located upstream or downstream of the card personalization mechanism, the label printer mechanism having an ink jet print engine that performs ink jet printing on labels to produce custom printed customer engagement labels, and a label transfer station that transfers the custom printed customer engagement labels onto the plastic cards.

In still another embodiment described herein, a method includes affixing a first customer engagement label from a label supply to a surface of a first card in a label mechanism, affixing a second customer engagement label from the label supply to a surface of a second card in the label mechanism, where the second customer engagement label has printed data that is different from printed data on the first customer engagement label, and the first customer engagement label and the second customer engagement label are affixed in sequence without stopping operation of the label mechanism to change the label supply.

DRAWINGS

FIG. 1A illustrates an example of a conventional card activation label applied to a card of a first card issuer.

FIG. 1B illustrates an example of a conventional card activation label applied to a card of a second card issuer.

Figure 2A:
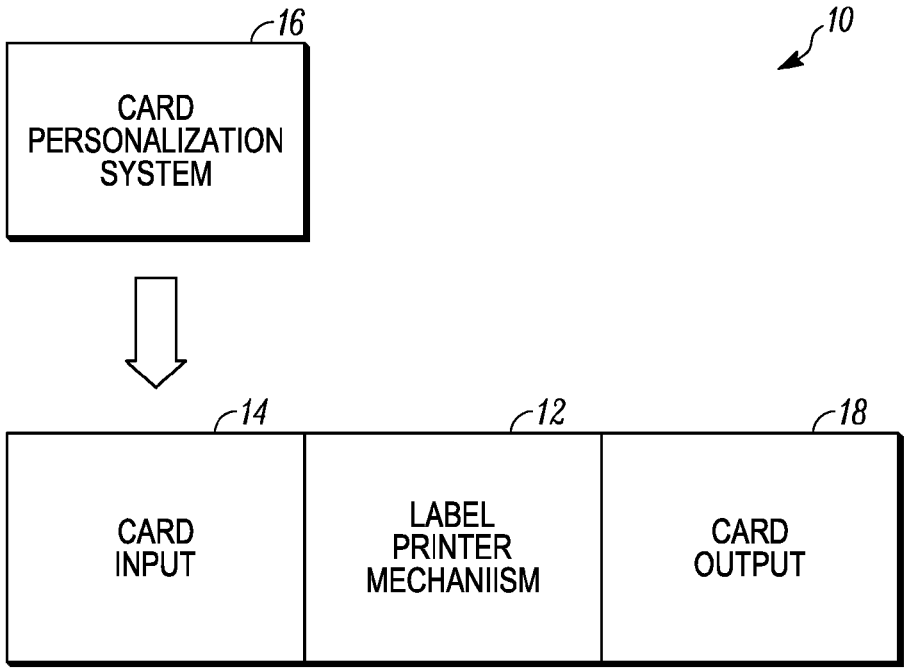

FIG. 2A schematically illustrates an embodiment where the label printer mechanism described herein is used off-line from a card personalization system.

Figure 2B:
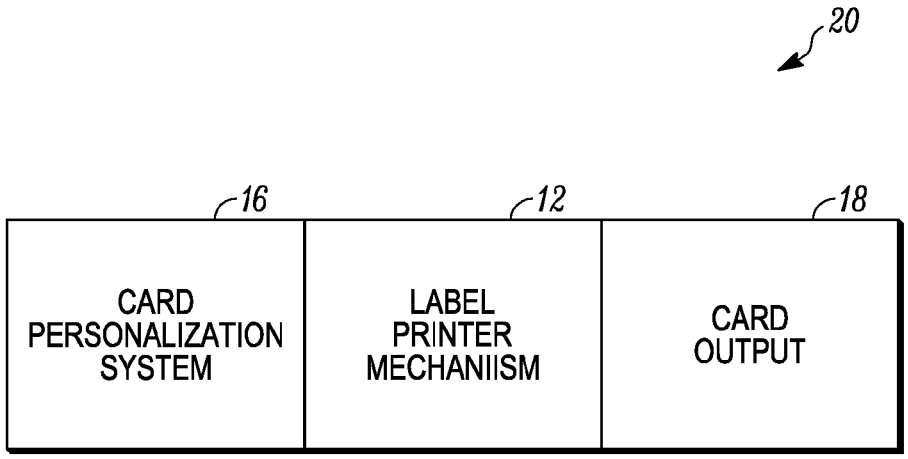

FIG. 2B schematically illustrates another embodiment where the label printer mechanism described herein is used in-line with a card personalization system.

Figure 3:
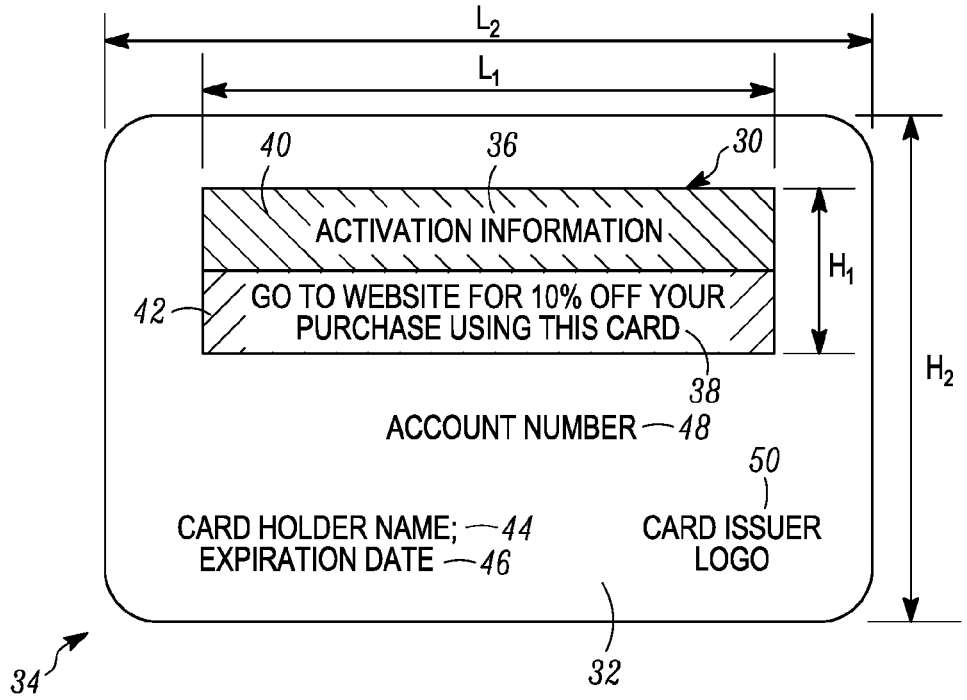

FIG. 3 illustrates an example of a custom printed customer engagement label that can be produced as described herein.

Figure 4:
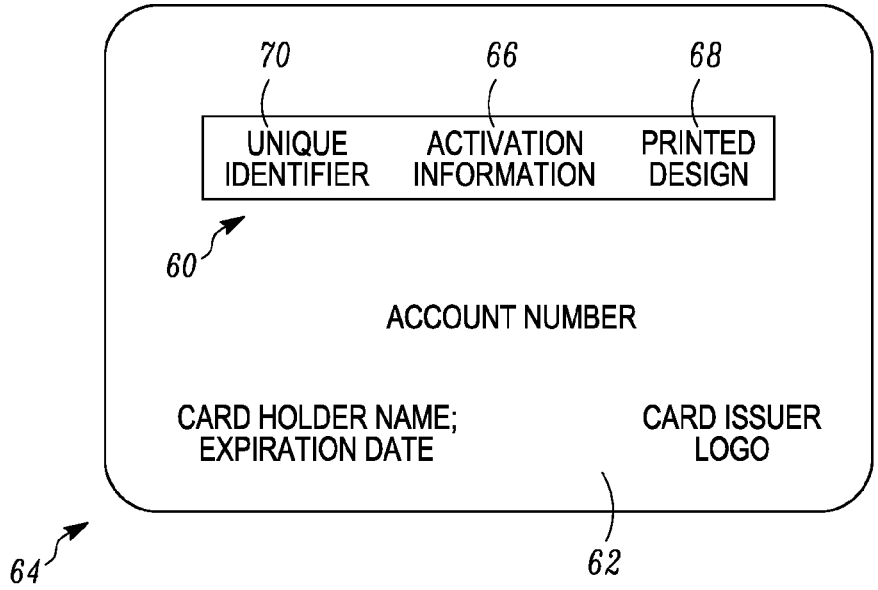

FIG. 4 illustrates another example of a custom printed customer engagement label that can be produced as described herein.

Figure 5:
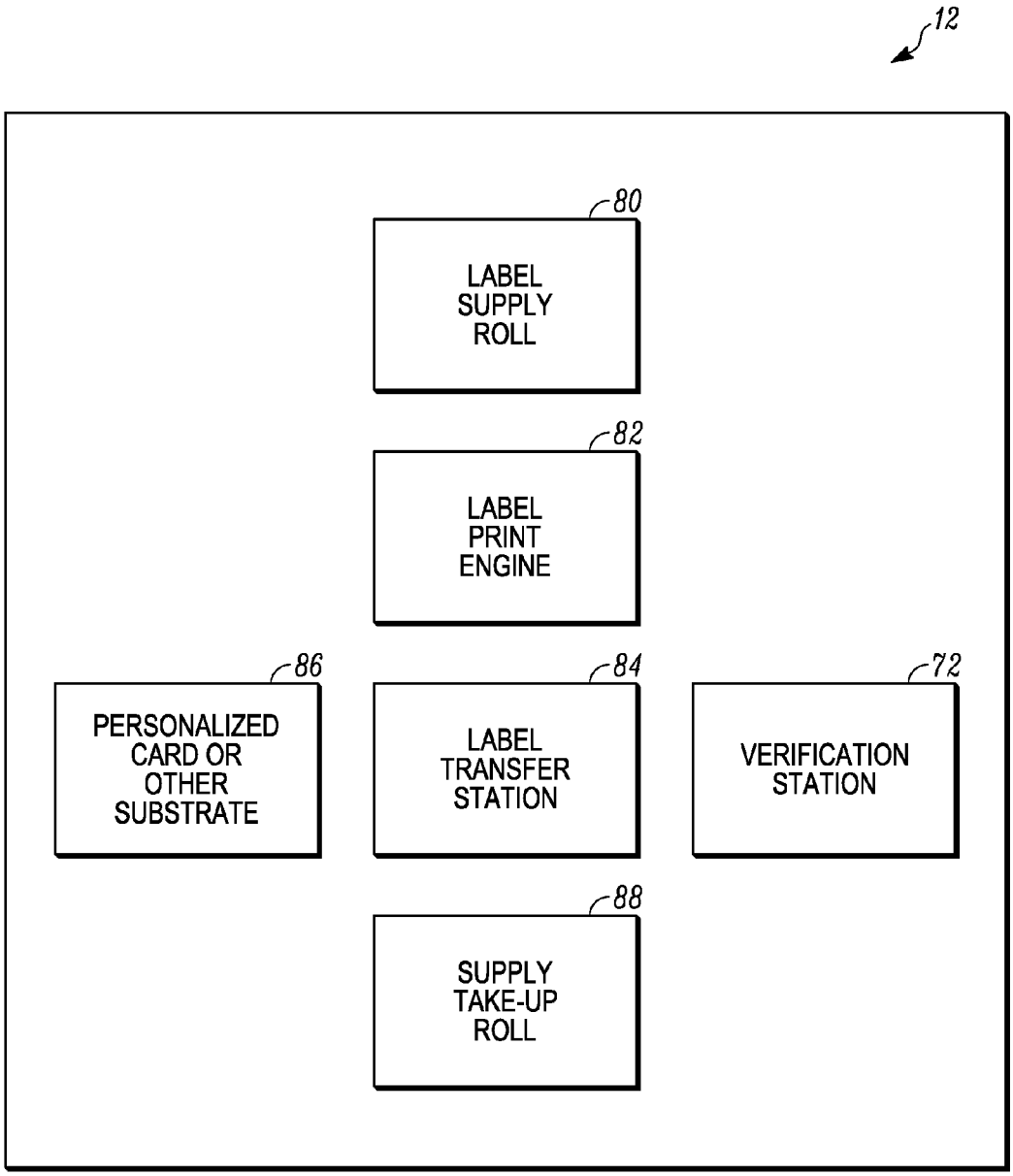

FIG. 5 schematically illustrates components of a label printer mechanism described herein.

Figure 6:
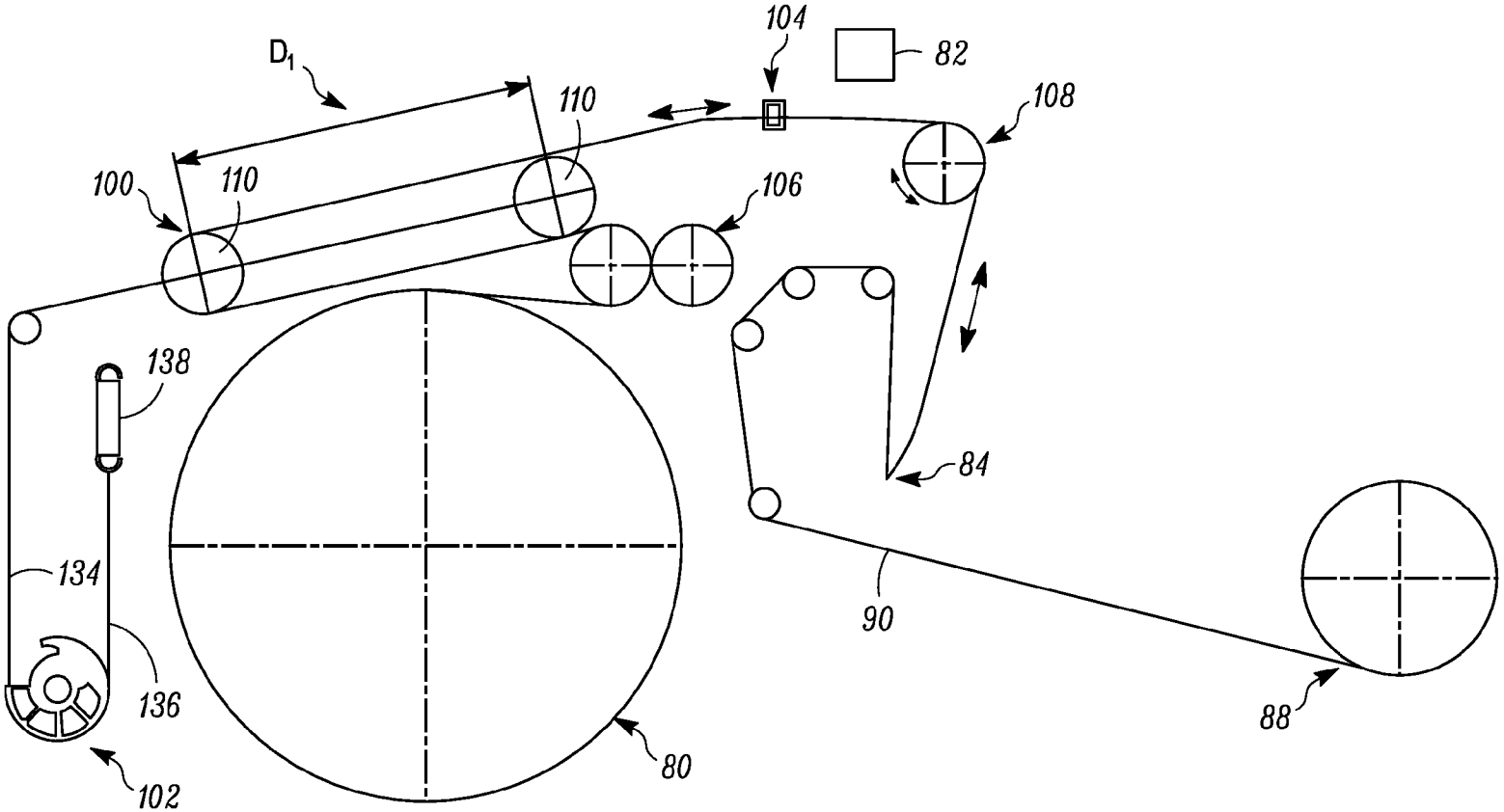

FIG. 6 illustrates an example of a carrier web travel path in the label printer mechanism described herein.

Figure 7A:
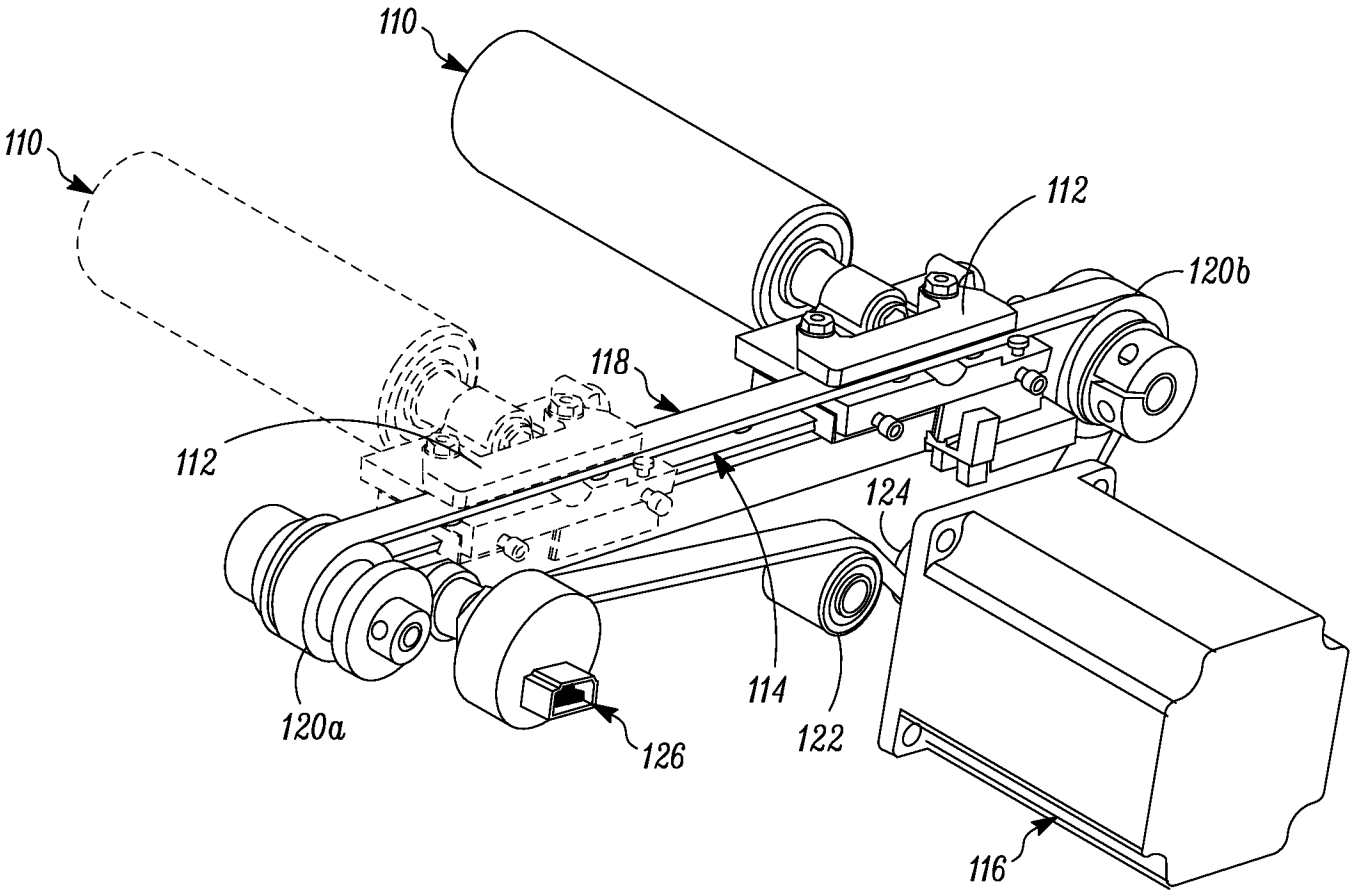
Figure 7B:
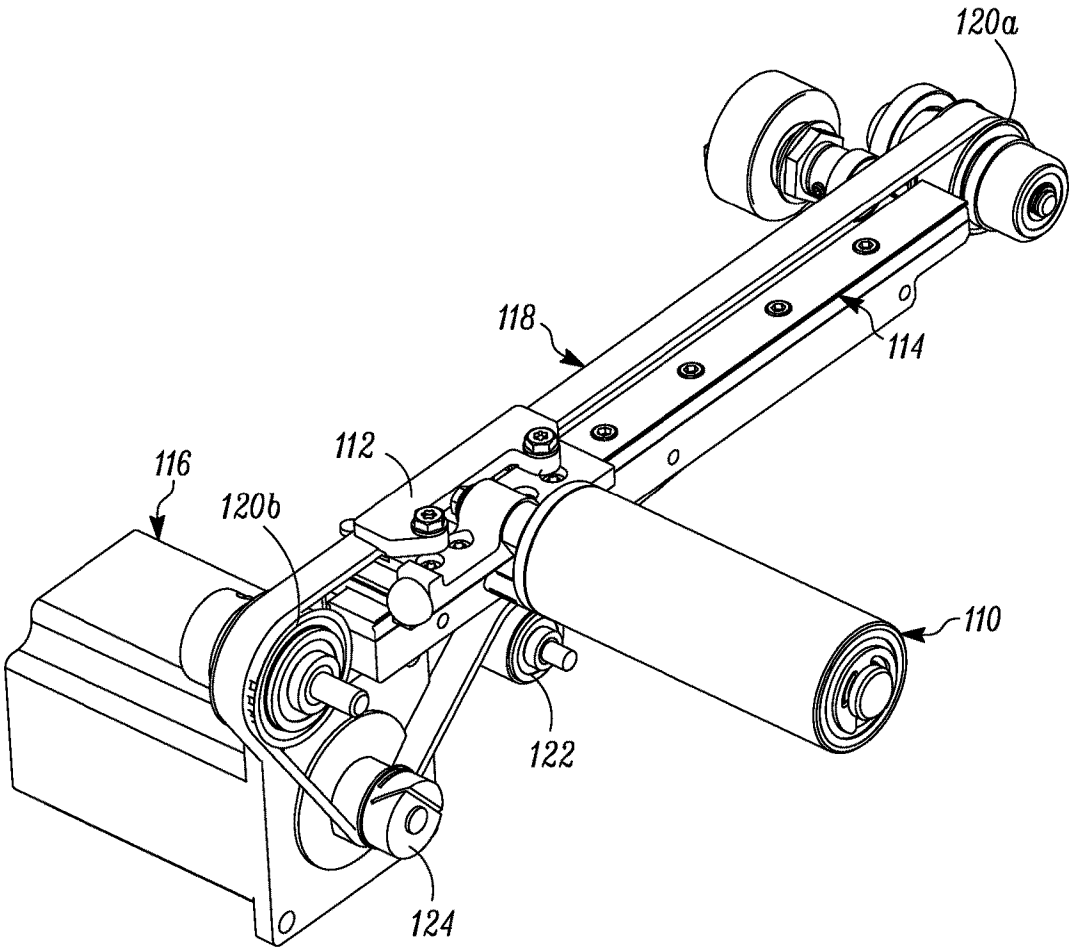

FIGS. 7A and 7B illustrate details of a driven accumulator mechanism that can be used in the label printer mechanism described herein.

Figure 8A:
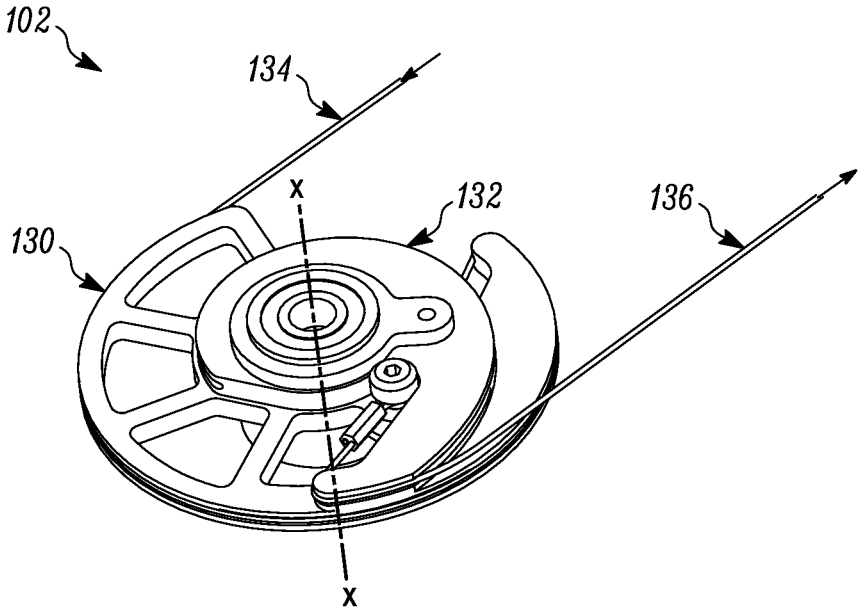
Figure 8B:
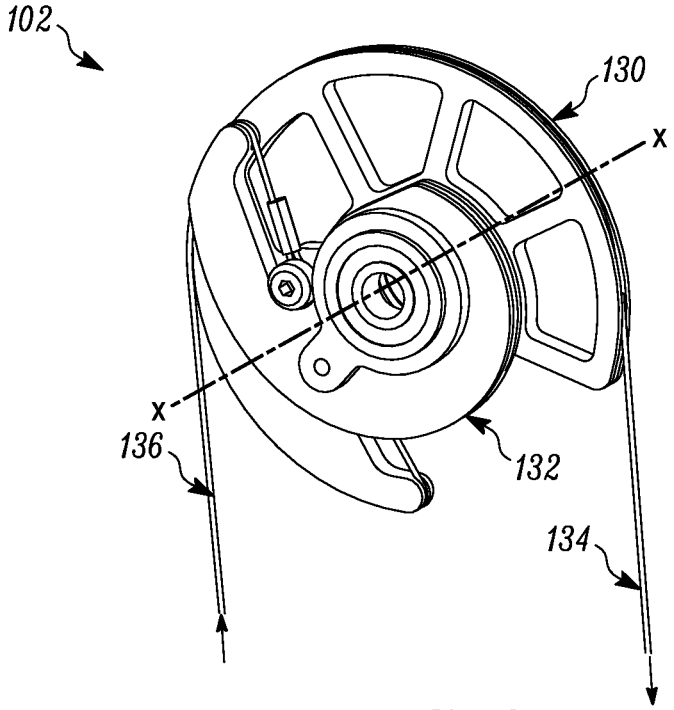

FIGS. 8A and 8B illustrate details of a constant force pulley cam that can be used in the label printer mechanism described herein.

Figure 9:
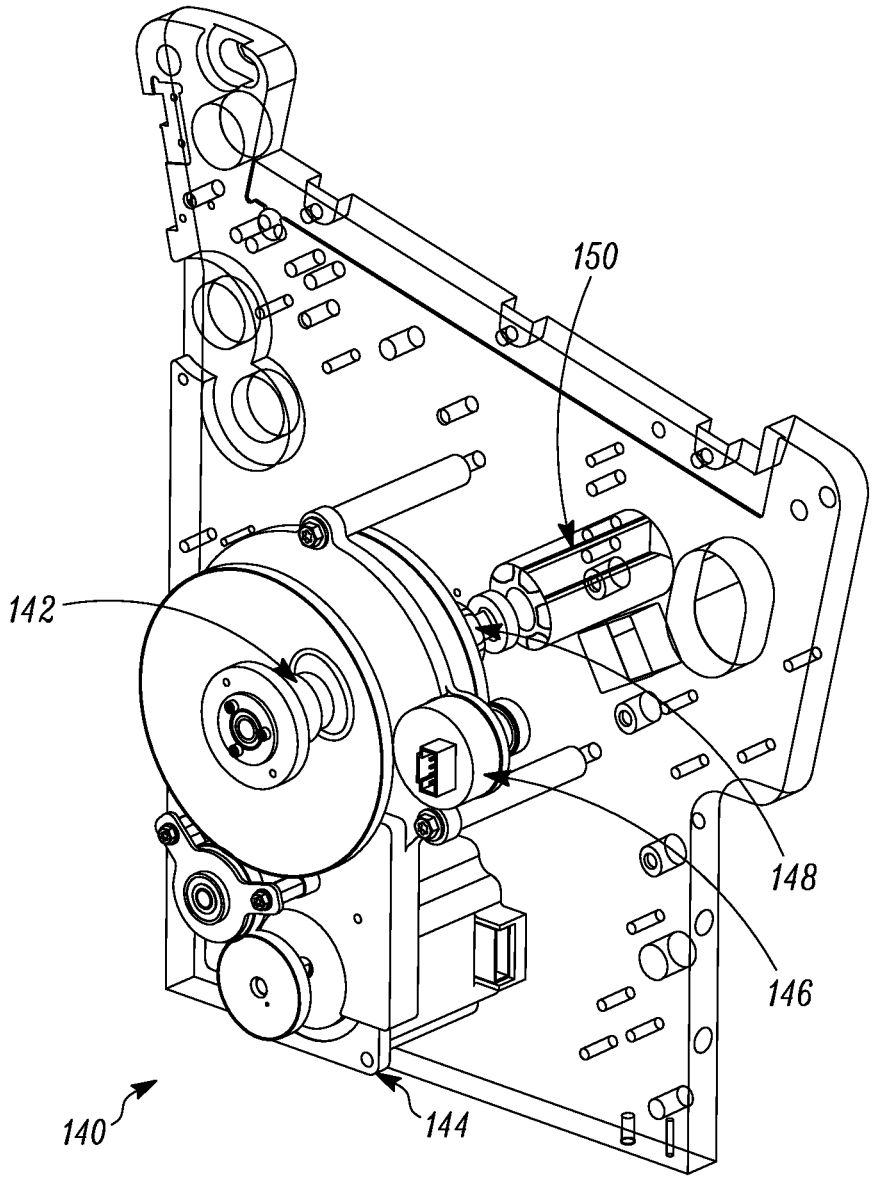

FIG. 9 illustrates details of an over-driven slip clutch supply drive that can be used in the label printer mechanism described herein.

Figure 10A:
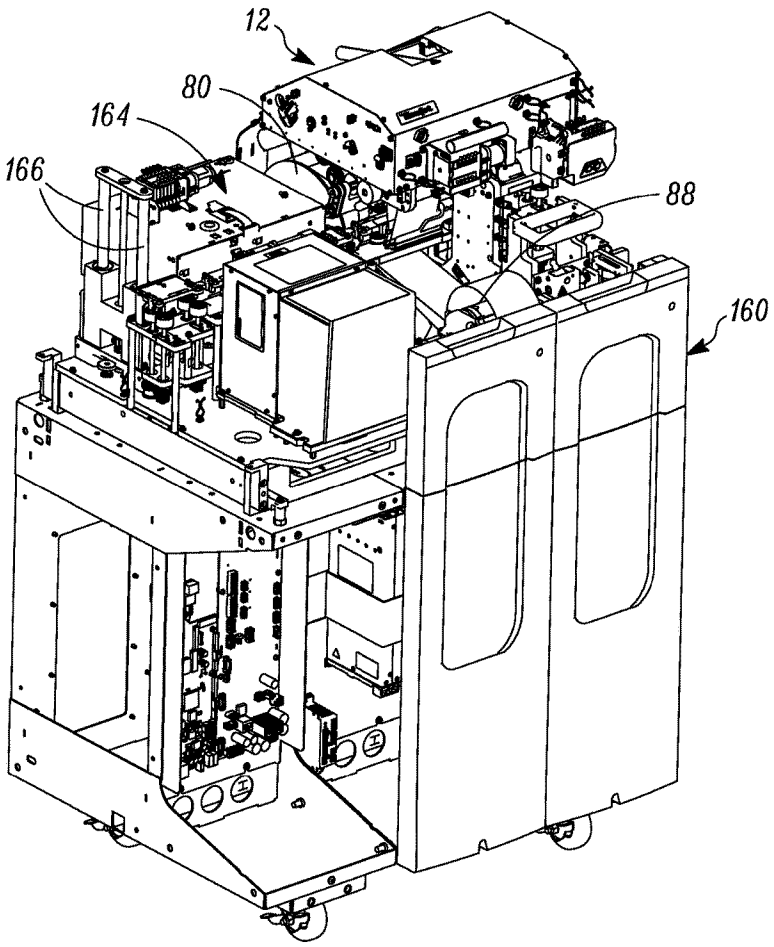
Figure 10B:
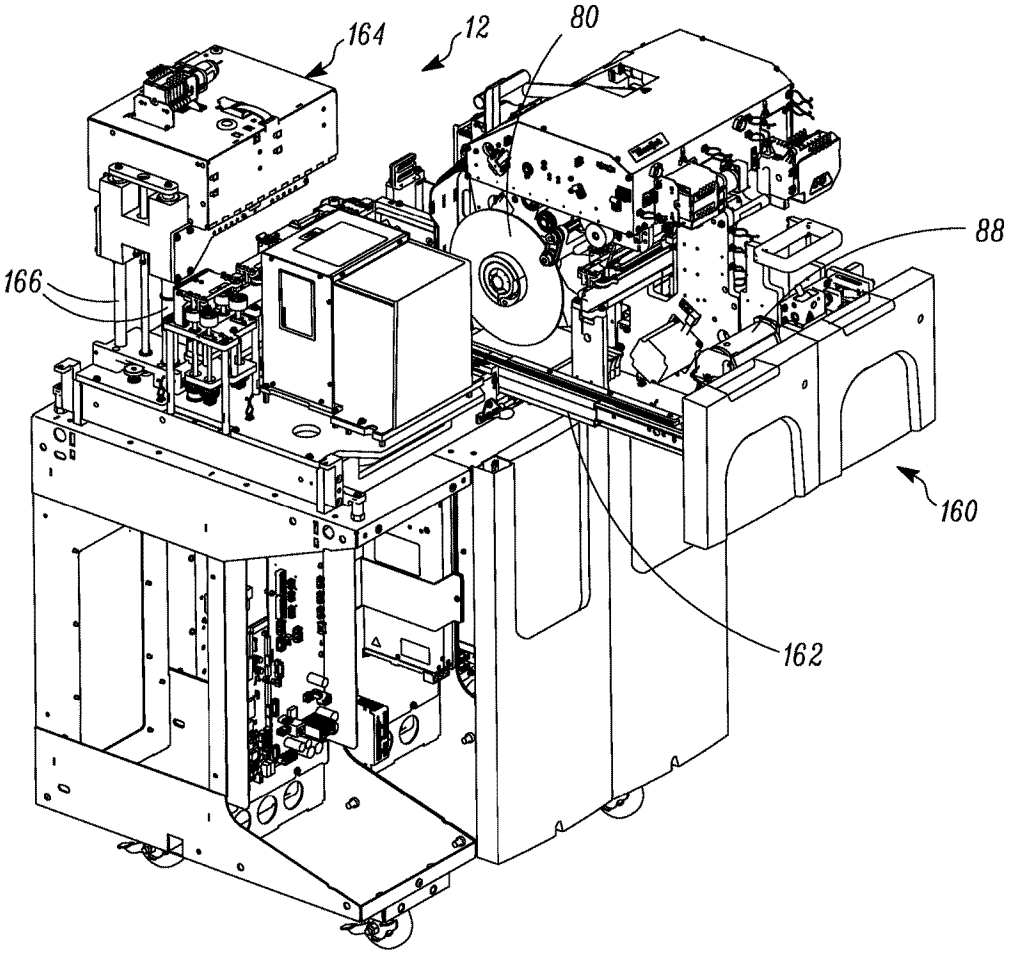

FIGS. 10A and 10B illustrate details of a sliding drawer that is coupled to a moveable ink cartridge housing that can be used in the label printer mechanism described herein.

Figure 11A:
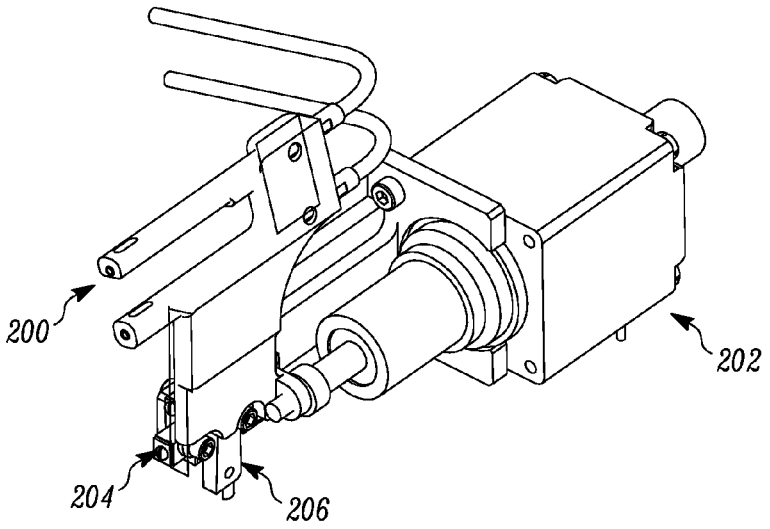
Figure 11B:
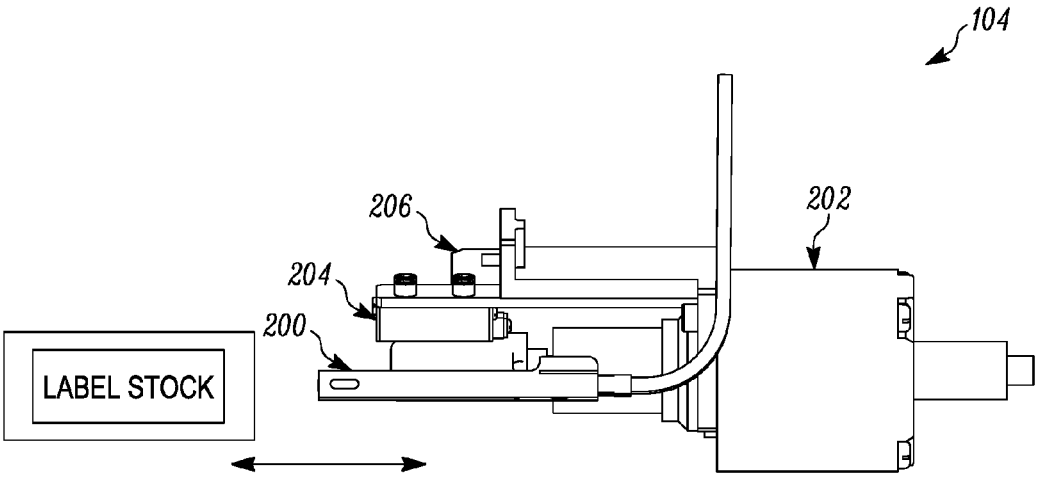

FIGS. 11A and 11B illustrate an example of an edge detection sensor.

DETAILED DESCRIPTION

The following is a detailed description of producing custom printed customer engagement labels. The customer engagement labels described herein can be affixed to any substrates that one may wish to affix the labels to. In one embodiment, the customer engagement labels can be affixed to personalized plastic cards, such as financial cards including credit and debit cards, identification cards, driver's licenses, and other personalized plastic cards that are distributed to customers such as in mailed envelopes. The custom printed customer engagement labels described herein can be applied to other substrates such as envelopes, letters, and other substrates, that are distributed to customers. For convenience, the substrates will hereinafter be described as being personalized plastic cards, or plastic cards, or personalized cards, or just cards. However, it is to be realized that the labels can be affixed to other substrates.

The custom printed customer engagement labels described herein can be used for a number of purposes including, but not limited to, providing instructions to the intended recipients of personalized plastic cards for activation of the personalized plastic cards, marketing of products and/or services to the recipients of the cards, and combinations of card activation and marketing.

As described further below, the custom printed customer engagement labels are printed and affixed to the cards in a label printer mechanism. The label printer mechanism includes a label supply roll containing a plurality of labels carried on a carrier web. A label print engine of the label printer mechanism can custom print each of the labels. After printing, a label transfer station of the label printer mechanism transfers the custom printed labels from the carrier web onto the plastic cards. The label printer mechanism can have any mechanical constructions suitable for achieving the functions and benefits described herein.

The label printer mechanism permits custom printing of the customer engagement labels in real-time. Therefore, a customer engagement label that is suitable for affixing to a card issued by one card issuer can be printed in real-time, and a customer engagement label that is suitable for affixing to a card issued by a second card issuer can be printed in real-time without changing the label supply. This allows custom labels to be printed and affixed to cards from different card issuer without substantially altering the label to card affix rate of the label printer mechanism since the printer mechanism does not need to be stopped to change out pre-printed label stock. By not having to change out pre-printed label stock, downtime of the label printer mechanism is reduced and/or eliminated and the label to card affix rate can be substantially maintained. In addition, each customer engagement label can be custom printed in real-time specifically for each card, and each customer engagement label can be personalized specifically for the card it is to be attached to. The label printer mechanism can have any mechanical constructions suitable for achieving the functions and benefits described herein.

The label printer mechanism described herein has a high card throughput. For example, in one embodiment, the label printer mechanism can print and affix custom printed labels at a rate (i.e. a label to card affix rate) of at least 500 cards per hour. In another embodiment, the label printer mechanism can print and affix custom printed labels at a rate of at least 1,000 cards per hour. In another embodiment, the label printer mechanism can print and affix custom printed labels at a rate of at least 1,500 cards per hour. In still another embodiment, the label printer mechanism can print and affix custom printed labels at a rate of at least 2,000 cards per hour. In still another embodiment, the label printer mechanism can print and affix custom printed labels at a rate of at least 2,500 cards per hour. The label printer mechanism can have any mechanical constructions suitable for achieving the functions and benefits described herein.

In addition, the labels can be printed when the carrier web that carries the labels is moving in a reverse or second direction opposite to the forward or first direction that the web moves during a step of affixing/attaching the labels to the personalized plastic cards. This reverse move printing helps to increase the label to card affix rate (i.e. printing and affixing the custom printed labels to the cards, measured for example in cards per hour). The label printer mechanism can have any mechanical constructions suitable for achieving the functions and benefits described herein.

In addition, the label printer mechanism can utilize an ink jet print engine that employs ink jet printing. The ink jet print engine can print on the labels in black and white or it can print full color. In one embodiment, a system described herein can include a card personalization mechanism that can personalize plastic cards, and a label printer mechanism located upstream or downstream of the card personalization mechanism. The label printer mechanism can have an ink jet print engine that performs ink jet printing on labels to produce custom printed customer engagement labels, and a label transfer station that transfers the custom printed customer engagement labels onto the plastic cards. The label printer mechanism and the system can have any mechanical constructions suitable for achieving the functions and benefits described herein.

The label printer mechanism permits the production and affixing of custom full color labels. The use of an ink jet print engine is not required. Any type(s) of print engine(s) that can print full color labels can be used. The label printer mechanism can have any mechanical constructions suitable for achieving the functions and benefits described herein.

Each label can be printed with a unique identifier including, but not limited to, a serial number, a two-dimensional bar code, and the like, that can be used to verify that the correct custom printed label has been, or will be, affixed to the intended card. The label printer mechanism can have any mechanical constructions suitable for achieving the functions and benefits described herein.

The label printer mechanism can also incorporate a unique sliding drawer and moveable ink cartridge housing that allows for easier access to both the label supply roll and to the ink cartridge housing for supply maintenance operations. The label printer mechanism can have any mechanical constructions suitable for achieving the functions and benefits described herein.

The label printer mechanism can be used as a "stand-alone" or an "off-line" mechanism where the label printer mechanism is not used directly in combination with a card personalization system where the personalized plastic cards are first personalized in a separate card personalization system and then separately loaded into an input of the label printer mechanism for processing by the label printer mechanism. For example, FIG. 2A illustrates an example of a system 10 with an "off-line" label printer mechanism 12. In this example, the system 10 also includes a card input 14, such as one or more card input hoppers, into which is loaded personalized plastic cards that have been personalized in a card personalization system 16. After the cards are personalized in the card personalization system 16, the personalized cards can be carried to the card input 14 and manually loaded into the card input 14 which feeds the cards one-by-one into the label printer mechanism 12. Cards with labels affixed thereto can then be gathered in a card output 18. The card output 18 can gather the cards for subsequent attachment to card mailers and mailing to intended recipients. Alternatively, the card output 18 can be a card mailing system that affixes the cards to card mailers, and inserts the mailer/card combinations into envelopes for subsequent mailing. An example of a card mailing system is described in U.S. Publication No. 2015-0085047, the entire contents of which are incorporated herein by reference.

In other embodiments, the label printer mechanism can be used as an "in-line" mechanism where the label printer mechanism is used directly in combination with a card personalization system that directly supplies personalized plastic cards to the label printer mechanism. For example, FIG. 2B illustrates an example of a system 20 where the label printer mechanism 12 is used in-line. In this example, the cards are personalized one-by-one in the card personalization system 16 and then are fed directly, one-by-one, into the label printer mechanism 12. Cards with labels affixed thereto can then be gathered in the card output 18. The card output 18 can gather the cards for subsequent attachment to card mailers and mailing to intended recipients. Alternatively, the card output 18 can be a card mailing system that affixes the cards to card mailers, and inserts the mailer/card combinations into envelopes for subsequent mailing. An example of a card mailing system is described in U.S. Publication No. 2015-0085047, the entire contents of which are incorporated herein by reference.

The card personalization system 16 in FIGS. 2A and 2B can be any system that is designed to perform one or more personalization and/or processing operations on plastic cards. Examples of personalization and/or processing operations include, but are not limited to, printing, programming a magnetic stripe or an integrated circuit chip, laminating, embossing, laser personalization, indent printing, and the like, all of which are well known in the art. Examples of the type of personalization that can be added to the card include, but are not limited to, the user's name, the user's address, a photograph of the user, an account number assigned to the user, and other types of data well known to those of ordinary skill in the art.

The card personalization system 16 is often referred to as a central issuance system that is often room sized, configured with multiple personalization/processing stations or modules performing different personalization/processing tasks, and that is generally configured to process multiple cards at once in relatively high processing volumes (for example, on the order of hundreds or thousands per hour). An example of a central issuance system is the MX and MPR line of card issuance systems available from Entrust Datacard Corporation of Shakopee, Minn. Central issuance systems are described in U.S. Pat. Nos. 6,902,107, 5,588,763, 5,451,037, and 5,266,781 which are incorporated by reference herein in their entirety.

As explained above, the label printer mechanism 12 can produce custom printed customer engagement labels. The label printer mechanism 12 can print customer engagement labels in black and white or in full color. FIG. 3 illustrates one example of a custom printed customer engagement label 30 that can be printed by the label printer mechanism 12. The label 30 is shown affixed to a surface 32 of a personalized plastic card 34. In this example, the label 30 is shown with a number of unique features each of which can be custom printed within the label printer mechanism 12. The label 30 is shown with custom printed activation information 36, such as a phone number and/or a website, suitable for activating the card 34. The activation information 36 is specific for the card issuer that issues the card 34. Therefore, for a first card issuer, the activation information 36 specific to the first card issuer will be printed, while for a second card issuer, the activation information 36 specific to the second card issuer will be printed. Therefore, cards from different card issuers can be fed into and processed by the label printer mechanism 12 in real-time, and depending upon which card issuer has issued the next card to be labeled, the label printer mechanism 12 can custom print the label with the activation information 36 suitable for that card issuer. As a result, the operation of the label printer mechanism 12 does not need to be stopped in order to change out a label supply based on the card issuer.

The label 30 is also shown with printed marketing information 38 that is printed by the label printer mechanism 12. The marketing information 38 can be any information, such as text, numbers, symbols, and/or graphics, used for marketing products and/or services to the intended recipient of the card 34.

The label 30 is also shown as including edge-to-edge full color printing. For example, an upper half of the label 30 can be printed by the label printer mechanism 12 in one color 40 while the bottom half can be printed by the label printer mechanism 12 with a second color 42. This is an example only. Any single color or combination of colors can be printed on the label 30 by the label printer mechanism 12. Further, the color printing need not be edge-to-edge. Any portion of the label 30 can be printed in full color. In addition, portions or all of the activation information 36 and/or marketing information 38 can be printed in full color or in black.

Still referring to FIG. 3, the surface 32 is illustrated as being a front surface of the card 34 with the label 30 affixed to the front surface. However, the label 30 can be fixed to the rear surface (not shown) of the card 34. The surface 32 is shown as including personalization information such as the name 44 of the intended card holder, expiration date 46, an account number 48 of the card 34 that is assigned to the card holder, and in some cases, non-personal information such as a card issuer logo 50 or card issuer name.

FIG. 4 illustrates another example of a custom printed customer engagement label 60 that can be printed by the label printer mechanism 12. The label 60 is shown affixed to a surface 62 of a personalized plastic card 64 that is issued by a card issuer different than the card issuer that issues the card 34 in FIG. 3. In this example, the label 60 is shown with custom printed activation information 66, such as a phone number and/or a website, suitable for activating the card 64. The activation information 66 is specific for the card issuer that issues the card 64.

The label 60 is also shown as being custom printed by the label printer mechanism 12 with a custom printed, full color or black and white design 68 for example a logo of the card issuer that issues the card 64, a logo that can be chosen by the intended card recipient, or any other custom printed design. The label 60 can also include a custom printed unique identifier 70. The identifier 70 can be used to verify that the correct label has been affixed to the correct card 64. For example, the identifier 70 can be a serial number, two-dimensional bar code, or any other identifier that corresponds to personalization information on the card 64. Alternatively, the identifier 70 can be unrelated to personalization information on the card 64, with the system reading the identifier 70 and knowing that the identifier 70 is on a label that is suitable for affixing or being affixed to a particular type of card. The labels 30 and 60 can be custom printed in sequence, one after the other, by the label printer mechanism 12.

The label printer mechanism 12 can custom print any desired data, graphics, and/or colors on the labels. The labels can include custom printed activation information, custom printed marketing information, combinations thereof; custom printed designs, logos and graphics; and/or one or more unique identifiers. The printing can be full color printing or black and white.

Referring to FIGS. 3 and 4, each of the labels 30, 60 has a length L1 that is less than the length L2 of the card 34, 64, and a height H1 that is less than the height H2 of the card 34, 64. The labels 30, 60 cover less than half of the surface area of the surface 32, 62. For example, the labels 30, 60 can cover about ⅓ or less, or about ¼ or less, of the surface areas of the surfaces 32, 62. In some embodiments, the printing that occurs on the labels 30, 60 can occur over the entire length L1 and height H1 of the labels 30, 60 (i.e. the printing can be edge to edge).

Just prior to affixing the label to the card 64, or after affixing the label 60 to the card 64, the identifier 70 can be read as part of a verification process to determine that the correct label will be or has been affixed to the correct card. Any verification process can be used as long as a determination can be made that the correct label will be or has been affixed to the correct card. For example, the label printer mechanism 12 can include a verification station 72 (shown schematically in FIG. 5) that can include a camera or other mechanism(s) that can read the identifier 70 or other printing from the custom printed label 60. In the verification station 72, some or all of the card surface is illuminated and an image of some or all of the card surface is captured by a camera. The system tracks the movement of the cards and by using a unique identifier 70 (for example, a bar code) on each label, the system can verify that, for example, card number 1 received label number 1 and that card number 2 received label number 2. The confirmation/verification is accomplished by vision verification (for example reading the bar code or unique identifier 70 using a camera) in association with the system knowing the relative positions of the cards in the label printer mechanism 12. The verification station 72 can read any data from the custom printed label 60 including, but not limited to, text, images, and barcodes as part of the verification process to ensure that the correct label has been applied to the correct card.

FIG. 5 schematically illustrates some example components of the label printer mechanism 12. In this example, the label printer mechanism 12 includes a label supply roll 80 that supplies labels to be printed on. A label print engine 82 custom prints on each label. After the label is printed, the label is transported to a label transfer station 84 where the custom printed label is transferred and affixed onto a surface of a personalized card 86 (or other substrate). After labels are transferred, a carrier web that carried the labels is wound up on a take-up roll 88. In addition, the card with the custom printed label affixed thereto is transported to the verification station 72 for the verification process. The verification station 72, the label supply roll 80, the label print engine 82, the label transfer station 84, and the take-up roll 88 can have any mechanical construction suitable for achieving the functions of each described herein.

For example, the label print engine 82 can perform ink jet printing on the labels to produce the custom printed customer engagement labels. The printing can be in black ink only or full color printing. In one embodiment, the ink jet printer can support 800 DPI, Cyan, Magenta, Yellow, Black (CMYK) color printing, with a color managed workflow and a large color gamut approaching lithographic print quality, with a print speed of up to approximately 12 inches per second. In one embodiment, the labels supplied on the supply roll 80 can be blank white labels eliminating the need to inventory and manage various quantities of pre-printed label stock that are currently affixed to cards today. A card production facility could potentially reduce their on-hand label stock inventory to a single, white label supply with the label printer mechanism 12 described herein. Machine operators, in turn, do not need to locate and load specific pre-printed label stock prior to production runs greatly reducing run setup time. Production administrators also have more options to combine smaller jobs into larger batches that were not previously possible due to multiple label stock requirements. In other embodiments, the labels supplied on the supply roll 80 can be colors other than white, and can have some pre-printing already applied prior to being printed on by the label print engine 82. The label print engine 82 can have one or more print heads for performing the printing on the labels.

The label transfer station 84 can have any suitable mechanical construction for achieving transfer and affixing of the custom printed labels to their associated cards. For example, the label transfer station 84 can have a construction like that disclosed in U.S. Pat. No. 6,896,022, the entire contents of which are incorporated herein by reference.

An example carrier web travel path in the label printer mechanism 12 is illustrated in FIG. 6. The label supply roll 80 comprises a roll of a carrier web 90 that carries a plurality of the labels thereon, with the labels spaced apart from one another on the carrier web 90. The supply take-up roll 88 is connected to the carrier web 90 and takes up the carrier web 90 after the labels are transferred. A web travel path is defined between the label supply roll 80 and the supply take-up roll 88 along which the carrier web 90 travels. The label print engine 82 is disposed along the web travel path so as to be able to print on the labels carried on the carrier web 90. The label transfer station 84 is disposed along the web travel path between the label print engine 82 and the supply take-up roll 88 for transferring the custom printed labels from the carrier web 90 onto the cards.

As indicated by the double-headed arrows in FIG. 6, the travel direction of the carrier web 90 is reversible at certain locations of the web travel path. Printing on the labels by the print engine 82 occurs during a reverse movement direction of the carrier web 90 (i.e. as the carrier web 90 is moving in a direction from the take-up roll 88 toward the supply roll 80). Printing during a reverse movement of the carrier web 90 helps to achieve high card throughput. In addition, printing during the reverse movement reduces the amount of the carrier web advanced in both the forward and reverse directions. After the label has been printed during the reverse move, the carrier web can begin to decelerate and stop, then begin advancing toward the label transfer station 84. If the label was printed during a forward move of the carrier web, the label position before printing would have to account for acceleration time and web velocity settle time. This would increase the total amount of web travel time required for printing. So reducing carrier web travel time helps to increase throughput. In addition, after a label is transferred onto a card, the distance of the reverse movement of the carrier web back to the label print engine 82 allows sufficient time to accelerate and stabilize the carrier web prior to printing a new label.

To help explain some of the advantages of printing during reverse movement of the carrier web, in one non-limiting example a distance from the print head of the label print engine 82 to an affixing shoe of the label transfer station 84 can be about 6.0 inches. After a custom printed label has been applied to a card, the direction of travel of the carrier web 90 is reversed so that the next label to be printed travels back toward the label print engine at a velocity of about 12.0 inches per second, and the next label is printed while moving in the reverse direction. After the next label has been printed, the carrier web 90 is advanced in the forward direction towards the label transfer station 84 at a velocity of up to 60 inches per second. This helps to provide a high card throughput, for example up to about 3500 cards per hour or greater.

Still referring to FIG. 6, the label printer mechanism 12 can also include a driven accumulator mechanism 100, a constant force pulley cam mechanism 102, an edge detection sensor 104, nip rollers 106 along the web travel path between the supply roll 80 and the driven accumulator mechanism 100, and an encoder drum 108.

Driven Accumulator Mechanism 100

The driven accumulator mechanism 100 will be described with reference to FIGS. 6, 7A and 7B. Common web handling control typically uses rubber nip rollers to control web velocity and direction. The use of nip rollers can work well at low and high speeds in a single direction of web travel with continuous web flow. However, in the case of high-speed bi-directional web travel directions, nip rollers can be problematic where precise registration of the labels on the carrier web, which tends to be thin and slippery, with a print head is required. In addition, with rubber nip rollers, slippage and roller wear can be problematic.

Another common practice is to use spring loaded accumulators to buffer the web prior to processing. Typically, the accumulators are fed by nip rollers which pull the web from a supply roll. This type of mechanism can provide consistent web tension when pulling the web material downstream for processing. However, when reversing the web direction and putting the web back into the accumulator, web speeds and acceleration times can be limited by the spring force and the mass of the accumulator.

The driven accumulator mechanism 100 is configured to control the velocity and direction of the carrier web 90 for printing the labels. Referring to FIGS. 7A and 7B, the mechanism 100 includes a driven accumulator roller 110 that is fixed to a movable slide 112 that is movable from the position shown in solid lines in FIG. 7A to the position indicated in dashed lines in FIG. 7A and back. The slide 112 is slideably disposed on a slide rail 114. A stepper motor 116 is in driving engagement with the slide 112 via a suitable drive mechanism. In the illustrated example, the drive mechanism includes an endless belt 118 that travels around pulleys 120*a*, 120*b* and a roller 122, and the belt 118 is driven by a roller 124 fixed to the output shaft of the motor 116. The slide 112, and the roller 110 fixed thereto, moves back and forth driven by the belt 118 and the motor 116 depending upon the direction of rotation of the motor drive shaft. As shown in FIG. 6, the roller 110 is movable a distance D1 that is substantially equal to the distance the carrier web 90 travels from the print head of the label print engine 82 to the label transfer station 84.

Referring to FIG. 6, the driven accumulator mechanism 100 is disposed along the travel path of the carrier web 90 between the supply roll 80 and the label print engine 82, for example between the nip rollers 106 and the label print engine 82. The carrier web 90 runs from the supply roll 80, between the nip rollers 106, and then a 180 degree wrap around the roller 110 thereby creating parallel web paths on both sides of the roller 110. This creates a doubling effect on the actual carrier web velocity. With the parallel web paths on both side of the accumulator roller 110 and assuming a web velocity of, for example, 60 inches per second as discussed above, the driven accumulator 110 only needs to travel at half the velocity of the carrier web 90. This helps to maintain a stable and accurate drive system for the carrier web 90 to achieve the desired high card throughput.

Returning to FIGS. 7A and 7B, an encoder mechanism 126 can be provided at a suitable location of the drive mechanism, for example connected to the pulley 120*a*, to track movement of the belt 118 and accordingly track movement of the roller 110. The construction and operation of encoder mechanisms for tracking movement is well known in the art.

In operation, the driven movement of the accumulator 110 translates the carrier web 90 forward and in reverse between the label print engine 82 and the label transfer station 84. Translating the carrier web 90 using the driven accumulator mechanism 100 provides a smooth and steady carrier web velocity without the concern of slippage and roller wear like the conventional systems discussed above. Another advantage is that the carrier web 90 can be translated between the supply roll 80 and the take-up roll 88 without moving the accumulator roll 110. The accumulator roller 110 can be positioned anywhere within the stroke limit D1 and become a passive idler roller allowing the web to translate between the supply side and the take-up side in both the forward and reverse directions. This reduces the complexity of synchronizing the carrier web 90 and the labels with the position of the accumulator roller 110 as compared to spring loaded accumulator systems.

Constant Force Pulley Cam Mechanism 102

The constant force pulley cam mechanism 102 will be described with reference to FIGS. 6, 8A and 8B. Stepper motors are commonly used for driving a wide range of mechanical mechanisms. Sizing the appropriate motor generally involves determining the desired rotational speed and the inertia of the system being driven. Common practice is that the load should require somewhere between 30% to 70% of the maximum motor torque, and the load to rotor inertia should be between 1:1 and 3:1. Microstepping is another common practice for driving stepper motors to reduce mechanical noise and increase resolution. A drawback to microstepping is that as the number of microsteps is increased, the incremental torque per microstep can drop significantly which may diminish accuracy.

Referring to the non-limiting example discussed above, the load to rotor inertia when the web 90 is being driven toward the label transfer station 84 can be, for example, about 1:1. However, the load to rotor inertia when the web 90 is driven back toward the label print engine 82 may be higher, for example about 6:1. The combination of varying the speed from 12 inches per second to 60 inches per second, as well as a considerable difference in load inertia depending upon the driving direction, makes smooth drive for printing complicated.

The constant force pulley cam mechanism 102 aids the driven accumulator mechanism 100 in controlling and stabilizing the bi-directional velocity of the carrier web 90. The constant force pulley cam mechanism 102 is attached directly to the driven accumulator mechanism 100 to help compensate for variation in load inertia and rotation velocity as well as reduces mechanical noise. The constant force pulley cam mechanism 102 together with the driven accumulator mechanism 100 provides a smooth and steady web velocity during printing in the label print engine 82.

Referring to FIGS. 6, 8A and 8B, the constant force pulley cam mechanism 102 is a rotatably mounted structure that rotates about a rotation axis X-X. The cam mechanism 102 includes a constant radius pulley section 130 and a changing radius cam section 132. A cable 134 is fixed at one end thereof to the constant radius pulley section 130 and, as best seen in FIG. 6, is fixed at its opposite end to the slide 112 that supports the accumulator roller 110. A second cable 136 is fixed at one end thereof to the changing radius cam section 132 and, as best seen in FIG. 6, is fixed at its opposite end to a fixed extension spring 138, such as one or more coil springs that provides the force for tensioning the accumulator roller 110. Since the cam mechanism 102 is connected to the roller 110 via the cable 134, movement of the roller 110 causes the cam mechanism 102 to rotate. As the cam mechanism 102 rotates, the cable 136 fixed to the changing radius cam section 132 starts to pull on the extension spring 138 which increases the force on the changing radius cam section 132. As the force is increasing, the cam radius changes to keep the cam torque constant and the force on the accumulator roller 110 constant. This constant force on the roller 110 provides steady state load on the roller 110 to provide smooth and steady velocity of the carrier web 90 during printing on the labels in the label print engine 82.

Edge Detection Sensor 104

The edge detection sensor 104 will be described with reference to FIGS. 6, 11A and 11B. The edge detection sensor 104 is positioned along the web travel path between the driven accumulator mechanism 100 and the label print engine 82. The edge detection sensor 104 detects an edge of a label on the carrier web 90. This can be used to adjust the position of the image to be printed on the label in the axis perpendicular to the print direction. The edge detection compensates for variations in web tracking, label sizes, and tolerances, as well as humidity conditions. This compensation is important for full edge to edge printing on the label and minimizing the amount of overspray of ink.

The sensor 104 can be any sensing mechanism suitable for sensing an edge of the label. For example, referring to FIGS. 11A and 11B, the sensor 104 can be a fiber optic sensor 200 coupled to a linear actuator motor 202 for determining the location of the vertical edge/edges of a label by sensing a transition between the carrier web, which can for example be substantially transparent, and the label which is substantially opaque. The sensor 104 is mounted for linear movement (as indicated by the arrows in FIG. 11B) on a ball slide mechanism 204 that is driven back and forth by the linear actuator motor 202. A sensor 206 determines a home position of the sensor 104.

After a label has been printed, the fiber optic sensor 200 translates from the home position towards the downstream side, locating the edge of the label. This location will be used to adjust the next label image to be printed. The upstream side of the label stock is considered to be the registration side of the label, as this side will nominally be in the same location regardless of the label stock size. The edge detection sensor 104 is also used monitor the consistency of the web tracking in the axis perpendicular to the print direction. The same sensor 104 can be used to locate the downstream edge of the label stock. Locating this edge of the label can verify the nominal stock size and measure the actual length of the label stock. Generally the tolerance of the label length can be controlled within +/−0.005 inches or less. However, high humidity conditions can cause the label stock to grow up to 10%.

The nip rollers 106 located between the supply roll 80 and the driven accumulator mechanism 100 pulls new carrier web 90 from the supply roll 80 as labels are affixed to the cards and the carrier web 90 is taken up on the take-up roll 88.

The encoder drum 108 is disposed along the web travel path, for example between the label print engine 82 and the label transfer station 84. As the carrier web 90 moves forward and reverse, the web 90 drives the encoder drum 180 which tracks the movement distance of the web 90.

Referring to FIGS. 6 and 9, the supply roll 80 is provided with an over-driven slip clutch supply drive mechanism 140. The drive mechanism 140 helps to control web tension and helps to achieve stable web velocity when printing the labels. To achieve edge to edge printing on the labels, the printed image is slightly larger than the actual label size. Assuming an ink jet printer is used, during printing, ink is sprayed beyond an outer perimeter edge of the label and is considered overspray. This overspray should be minimized in order to conserve ink. In addition, the carrier web 90 is hydrophobic and will not absorb ink. So minimizing overspray will help to prevent ink from migrating from the carrier web 90 to other parts of the label printer mechanism 12 which could compromise the performance of the label printer mechanism 12 or components thereof. In addition, too much overspray can over saturate the perimeter of the label where ink can be wicked into the edge of the label. This can be problematic when the card with the printed label affixed thereto is attached to a mailing form and sent through the mail to the intended recipient. The over saturated edges of the label can transfer ink to the area of the mailing form that is folded over on top of the printed label. The over-driven slip clutch supply drive mechanism 140 helps to minimize overspray.

Details of the over-driven slip clutch supply drive mechanism 140 are illustrated in FIG. 9. The mechanism 140 includes a slip clutch 142, a stepper motor 144 that drives the supply roll 80, an encoder mechanism 146 that tracks rotation of a supply spindle shaft 148 that is driven by a suitable drive train between the stepper motor 144 and the supply spindle shaft 148. A supply spindle 150 is mounted on and rotates with the supply spindle shaft 148. The supply roll is not illustrated in FIG. 9 for sake of convenience in order to illustrate the supply spindle.

The over-driven slip clutch supply drive mechanism 140 allows the stepper motor 144 to continuously drive in the opposite direction from a normal feed direction. The nip rollers 106 pull new carrier web 90 from the supply roll 90 at a desired supply rate, for example about 8 inches per second, and the supply roll 90 is driven in the opposite direction at a desired rate, for example about 20% higher than the nip roller feed rate. This over-driven supply method maintains web tension between the supply roll 90 and the nip rollers 106. Lack of tension between the supply roll 90 and the nip rollers 106 can cause lateral drift of the carrier web 90 which leads to web tracking issues for downstream processing. Over-driving the supply roll 90 helps equalize the web tension on both sides of the nip rollers 106 when the driven accumulator 110 translates the carrier web 90 in the forward and reverse directions. This improves the effect the backlash in the nip roller drive can have on the variation in the web velocity, especially when printing on the labels in the label print engine. In addition, the encoder mechanism 146 can detect if the supply roll is empty, as well as detect if there is a break in the carrier web between the supply roll 90 and the nip rollers 106.

In the label printer mechanism 12, consumable supply items in the label printer mechanism 12 need to be readily accessible by operating or maintenance personnel for replenishing or replacing the consumable supply items. In the label printer mechanism 12, examples of consumable supply items include the supply roll 80 and take-up roll 88 and, in the case of ink jet printing, the ink supply used for the ink jet printing. In addition, mechanical elements of the label print mechanism 12 may need servicing from time to time. Referring to FIGS. 10A and 10B, many of the components of the label print mechanism 12 illustrated in FIG. 6, such as the supply roll 80, the take-up roll 88, the label print engine 82, and the label transfer station 84, are disposed on a sliding drawer 160 that can manually be slid horizontally between a use or operational position (shown in FIG. 10A) and a non-use or maintenance position (shown in FIG. 10B). The drawer 160 can include a rail mechanism 162 that permits the sliding movements between the positions shown in FIGS. 10A and 10B. By manually sliding the drawer 160 outward to the position shown in FIG. 10B, the supply roll 80 and the take-up roll 88 can be removed and replaced. In addition, this provides maintenance access to the major mechanical components of the label printer mechanism 12.

With continued reference to FIGS. 10A and 10B, in the case where the label printer mechanism 12 performs ink jet printing on the labels, ink for the ink jet printing can be stored in an ink cartridge housing 164 that is separate from the drawer 160. The ink cartridge housing 164 is configured to be slidable vertically up and down between a lowered use or operational position (shown in FIG. 10A) and a vertically raised non-use or maintenance position (shown in FIG. 10B). The ink cartridge housing 164 is slidable on fixed guide rods 166. By sliding the ink cartridge housing 164 upward to the position shown in FIG. 10B, the ink supplies within the ink cartridge housing 164 are more readily accessible for removal and replacement with new ink supplies.

In one embodiment, the slideable drawer 160 is mechanically coupled to the ink cartridge housing 164 so that when the drawer 160 is manually slid outward to the position shown in FIG. 10B the ink cartridge housing 164 is mechanically raised upward to its vertically raised non-use or maintenance position by the movement of the drawer 160. Likewise, when the drawer 160 is manually slid inward back to the use or operational position shown in FIG. 10A the ink cartridge housing 164 is mechanically lowered to its lowered use or operational position (shown in FIG. 10A) by the movement of the drawer 160. When the drawer 160 reaches its non-use or maintenance position shown in FIG. 10B, the ink cartridge housing 164 is retained at its vertically raised position until the drawer 160 is horizontally slid back to its use or operational position. Any mechanical linkage between the drawer 160 and the ink cartridge housing 164 can be used to couple the horizontal movements of the drawer 160 to result in vertical movements of the ink cartridge housing 164.

In one embodiment, a first customer engagement label from a label supply can be affixed to a surface of a first card in a label mechanism, and a second customer engagement label from the label supply can be affixed to a surface of a second card in the label mechanism. The second customer engagement label has printed data that is different from printed data on the first customer engagement label, and the first customer engagement label and the second customer engagement label are affixed in sequence without stopping operation of the label mechanism to change the label supply. In this embodiment, the printing of the first and second customer engagement labels can occur in the label mechanism as described above for the label printer mechanism 12 or the first and second customer engagement labels can be pre-printed before the label supply is loaded in the label mechanism in which case the mechanism 12 can be used without implementing printing, or a mechanism without printing capability can be used that is similar to the mechanism 12.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. In a label printer mechanism, a method comprising:

printing on a first label in the label printer mechanism to produce a first custom printed customer engagement label, the first custom printed customer engagement label being printed with a first set of data;

within the label printer mechanism, affixing the first custom printed customer engagement label to a surface of a first personalized plastic card;

after the first custom printed customer engagement label is produced, printing on a second label in the label printer mechanism to produce a second custom printed customer engagement label, the second custom printed customer engagement label being printed with a second set of data that differs from the first set of data; and within the label printer mechanism, affixing the second custom printed customer engagement label to a surface of a second personalized plastic card;

wherein the label printer mechanism has a label to card affix rate that is at least 500 cards per hour;

wherein the first custom printed customer engagement label and the second custom printed customer engagement label are produced in sequence without substantially altering the label to card affix rate of the label printer mechanism.

2. The method of claim 1, wherein the first personalized plastic card comprises a credit card or a debit card and the second personalized plastic card comprises a credit card or debit card.

3. The method of claim 1, wherein the first personalized plastic card comprises a driver's license and the second personalized plastic card comprises a driver's license.

4. The method of claim 1, wherein after printing on the first label, the first custom printed customer engagement label is transported in a first direction prior to affixing the first custom printed customer engagement label to the surface of the first personalized plastic card; and printing on the second label comprises printing on the second label as the second label is transported in a second direction opposite the first direction.

5. The method of claim 1, wherein the printing on the first label occurs with the first label disposed on a web; the printing on the second label occurs with the second label disposed on the web; affixing the first custom printed customer engagement label to the surface of the first personalized plastic card comprises removing the first custom printed customer engagement label from the web; and affixing the second custom printed customer engagement label to the surface of the second personalized plastic card comprises removing the second custom printed customer engagement label from the web.

* * * * *